US010556452B2

(12) United States Patent
Aoki

(10) Patent No.: US 10,556,452 B2
(45) Date of Patent: Feb. 11, 2020

(54) PRINTING APPARATUS AND METHOD OF POSITIONING SUPPORT SECTION

(71) Applicant: SEIKO EPSON CORPORATION, Tokyo (JP)

(72) Inventor: Hiroki Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/883,913

(22) Filed: Jan. 30, 2018

(65) Prior Publication Data

US 2018/0222221 A1 Aug. 9, 2018

(30) Foreign Application Priority Data

Feb. 3, 2017 (JP) ..... 2017-018701

(51) Int. Cl.

| | |
|---|---|
| ***B41J 11/06*** | (2006.01) |
| ***B41J 11/00*** | (2006.01) |
| ***B41J 15/04*** | (2006.01) |
| ***B41J 25/308*** | (2006.01) |
| ***B41J 15/16*** | (2006.01) |

(52) U.S. Cl.

CPC ..... *B41J 11/06* (2013.01); *B41J 15/04* (2013.01); *B41J 15/16* (2013.01)

(58) Field of Classification Search

CPC ..... B41J 11/06; B41J 15/04; B41J 11/0045; B41J 11/02; B41J 25/308

See application file for complete search history.

(56) References Cited

U.S. PATENT DOCUMENTS

2009/0079795 A1* 3/2009 Motoharu ..... B41J 11/002 347/56

FOREIGN PATENT DOCUMENTS

| | | |
|---|---|---|
| JP | 2004-291396 A | 10/2004 |
| JP | 2005-246759 A | 9/2005 |
| JP | 2013-119217 A | 6/2013 |

* cited by examiner

*Primary Examiner* — Jason S Uhlenhake

(74) *Attorney, Agent, or Firm* — Workman Nydegger

(57) ABSTRACT

There is provided a printing apparatus that includes a print section configured to perform printing onto a medium, a support section configured to support the medium, a base section to which the support section is attached, and a contact section configured to be attached to the base section so as to be movable to come into contact with the support section and being configured such that a position of the contact section with respect to the base section is not changed when the support section is detached from the base section.

7 Claims, 13 Drawing Sheets

PRINTING APPARATUS AND METHOD OF POSITIONING SUPPORT SECTION

BACKGROUND

1. Technical Field

The present invention relates to a printing apparatus and a method of positioning a support section.

2. Related Art

Various printing apparatuses have been used, and among such printing apparatuses, printing apparatuses that have a support section for supporting a medium are provided. For example, JP-A-2013-119217 discloses a printing apparatus that has a platen as a support section.

Such printing apparatuses that have a support section for supporting a medium as described in JP-A-2013-119217 require replacement of components, such as a support section, deteriorated with time in the use of the printing apparatuses. To replace a support section, the existing support section is detached from the base section and a new support section is attached to the base section; however, due to the change in conditions of attaching the support section with respect to the base section, the position (height) of the support section may be changed in some cases. In the printing apparatus disclosed in JP-A-2013-119217, the position (height) of the platen (support section) can be adjusted. However, adjusting the position of the support section is troublesome and it is required to suppress the changes in position of the support section due to the replacement of the support section.

SUMMARY

An advantage of some aspects of the invention is that there is provided a printing apparatus that can suppress changes in position of a support section due to replacement of the support section.

According to an aspect of the invention, a printing apparatus includes a print section configured to perform printing onto a medium, a support section configured to support the medium, a base section to which the support section is attached, and a contact section configured to be attached to the base section so as to be movable to come into contact with the support section and being configured such that a position of the contact section with respect to the base section is not changed when the support section is detached from the base section.

According to this aspect, a contact section is configured to be attached to a base section so as to be movable to come into contact with a support section, and being configured such that a position of the contact section with respect to the base section is not changed when the support section is detached from the base section. With this structure, when the support section is detached from the base section, the position of the contact section is not changed, and thereby changes in position of the support section due to the replacement of the support section can be suppressed.

In this printing apparatus, it is preferable that the contact section include a first section configured to be operated to move the contact section and a second section configured to be brought into contact with the support section.

With this structure, the contact section includes a first section configured to be operated to move the contact section and a second section configured to be brought into contact with the support section, which are provided separately. Accordingly, the respective functions of the first section and the second section can be clearly separated, and the operation of moving the contact section can be appropriately performed.

In this printing apparatus, it is preferable that the first section be configured not to come into contact with the support section and a coefficient of static friction of the second section be lower than a coefficient of static friction of the first section.

In this structure, a coefficient of static friction of the second section that is configured to be brought into contact with the support section is lower than that of the first section that is configured not to come into contact with the support section, that is, the coefficient of static friction of the second section that is configured to be brought into contact with the support section is relatively low. Accordingly, even if the support section expands due to environmental changes such as heat, deformation of the support section due to the increased frictional force and holding force can be suppressed.

In this printing apparatus, it is preferable that the first section be an external thread to which the contact section as the second section can be attached.

In this printing apparatus, the first section is an external thread to which the contact section as the second section can be attached. With this structure, the first section, which is operated to move the contact section, and the second section, which can be brought into contact with the support section, can be separately and readily provided.

In this printing apparatus, it is preferable that the support section have an opening through which the contact section can be accessed from a print section side.

In this printing apparatus, the support section has an opening through which the contact section can be accessed from a print section side. Consequently, the contact section can be accessed through the print section side and moved. Accordingly, especially in a structure in which a large work space can be provided on the print section side in the support section, the contact section can be readily operated to be moved. The expression "the contact section can be accessed" means that an operation for moving the contact section can be performed.

In this printing apparatus, it is preferable that the contact section be accessible in a direction intersecting a facing direction in which the print section and the support section face each other.

In this printing apparatus, the contact section can be accessed in a direction intersecting a facing direction in which the print section and the support section face each other. Consequently, even in a structure in which a large work space cannot be provided on the print section side in the support section, the contact section can be readily operated to be moved in the direction intersecting the facing direction.

According to another aspect of the invention, a method of positioning a support section for a printing apparatus that includes a print section configured to perform printing onto a medium, a support section configured to support the medium, a base section to which the support section is attached, and a contact section configured to be attached to the base section so as to be movable to come into contact with the support section and being configured such that a position of the contact section with respect to the base section is not changed when the support section is detached from the base section is provided. The method includes operating the contact section to bring the contact section into contact with the support section.

According to this aspect, a contact section is configured to be attached to a base section so as to be movable to come into contact with a support section, and being configured such that a position of the contact section with respect to the base section is not changed when the support section is detached from the base section. Consequently, the position of the contact section is not changed even after the support section is detached from the base section, and the contact section is operated to be moved to come into contact with the support section, and thereby changes in position of the the support section due to the replacement of the support section can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to a first embodiment of the invention will be described with reference to the attached drawings.

First Embodiment (FIG. 1 to FIG. 8)

Figure 1:
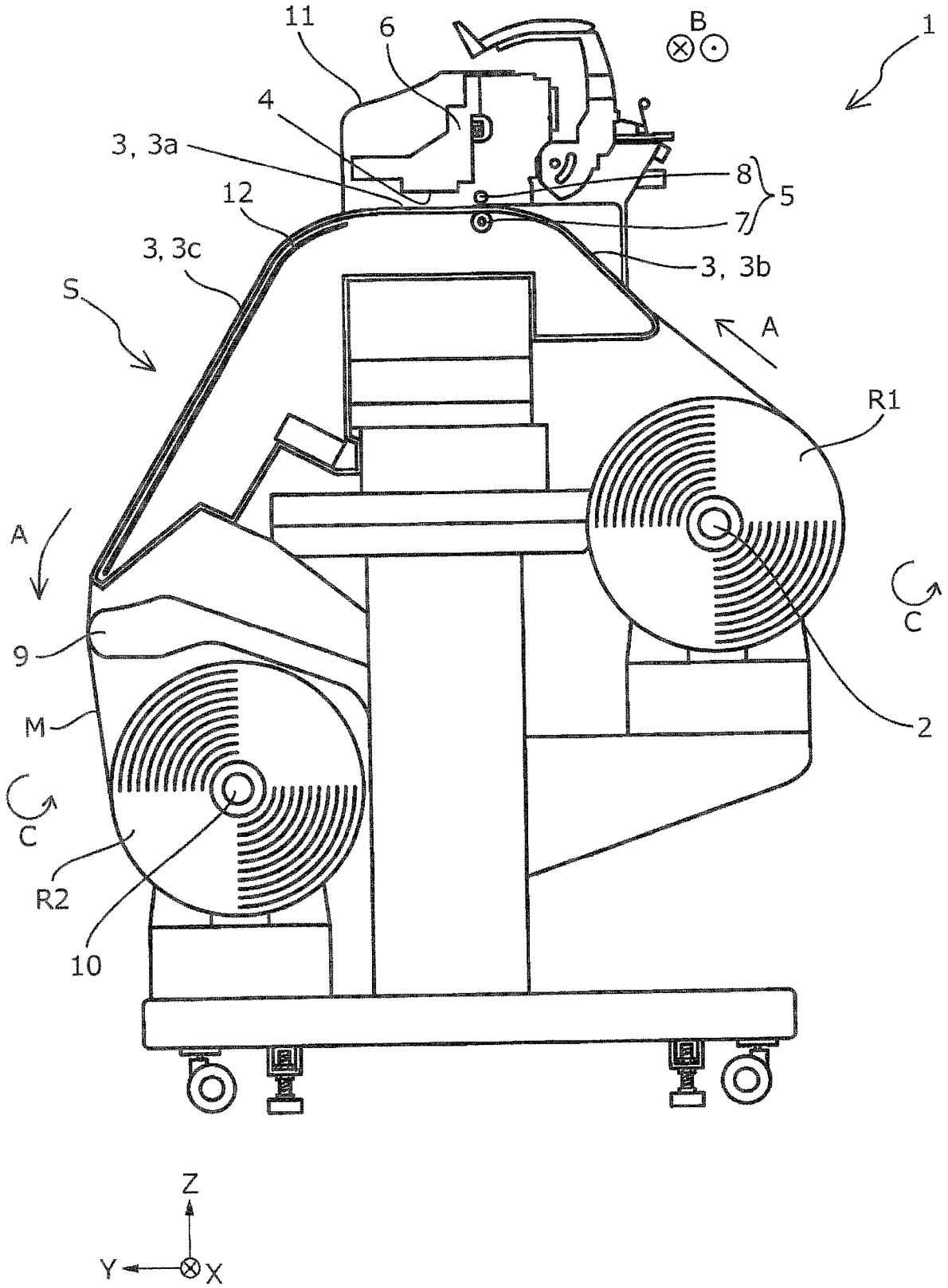
FIG. 1 is a schematic side view of a printing apparatus according to a first embodiment of the invention.

First, an overview of a printing apparatus according to the first embodiment of the invention will be described. FIG. 1 is a schematic side view of a printing apparatus 1 according to the embodiment.

The printing apparatus 1 according to the embodiment includes a support shaft 2 that supports a roll R1 of a rolled medium M for printing. In the printing apparatus 1 according to the embodiment, the support shaft 2 rotates in a rotation direction C to transport the medium M in a transport direction A. In this embodiment, the rolled medium M that is wound such that its print side is outward is used. When a rolled medium M that is wound such that its print side is inward is used, however, the support shaft 2 may be rotated in an opposite direction to the rotation direction C to feed the roll R1. The printing apparatus 1 according to the embodiment uses the rolled medium as the medium M; however, the printing apparatus is not limited to the printing apparatus that uses such a rolled medium. For example, a single-cut medium may be used.

The printing apparatus 1 according to the embodiment includes a transport roller pair 5 that has a driving roller 7 and a driven roller 8 for transporting the medium M in the transport direction A in a transport path of the medium M. The transport path includes a support section 3 for supporting the medium M. The support section 3 includes a support section 3*a* that is provided in an area facing a print section 4, which will be described below, a support section 3*b* that is provided on an upstream side of the support section 3*a* in the transport direction A, and a support section 3*c* that is provided on a downstream side of the support section 3*a* in the transport direction A. The area where the support section 3*a*, which is a main component of the printing apparatus 1 according to this embodiment, is provided will be described in detail below. In the printing apparatus 1 according to the embodiment, the driving roller 7 is a single roller that extends in a scanning direction B that intersects the transport direction A of the medium M, and the driven roller 8 includes a plurality of rollers that are disposed in the scanning direction B in an area that faces the driving roller 7.

A heater 12 that serves as a heating section that can heat the medium M, which is supported by the support section 3, is provided below the support section 3 on the downstream side (an area corresponding to the support section 3*c*) of the print section 4 in the transport direction A of the medium M. As described above, the printing apparatus 1 according to the embodiment includes the heater that can heat the medium M from the side of the support section 3. Alternatively, the printing apparatus 1 may include an infrared heater that is provided at a position facing the support section 3, for example.

The printing apparatus 1 according to the embodiment includes, in a casing section 11, the print section 4 and a carriage 6. The print section 4 serves as an ink jet head that ejects an ink from nozzles, which are provided on a nozzle formed surface, for printing. The carriage 6 equipped with the print section 4 can reciprocate in the scanning direction B. In the printing apparatus 1 according to the embodiment, the transport direction A of the medium M at the position on the support section 3 facing the print section 4 (nozzle formed surface) is a direction along a direction Y that is a horizontal direction, the scanning direction B of the print section 4 is a direction along a direction X that is a horizontal direction and orthogonal to the direction Y, and an ink discharge direction is a direction (vertically downward direction) along a direction Z that is a vertical direction.

As described above, the print section 4 can discharge an ink from nozzles (not illustrated) onto a transported medium M while reciprocating in the scanning direction B, which intersects the transport direction of the medium M, and thereby printing is performed. With the print section 4 having such a structure, the printing apparatus 1 according to the embodiment repeats transporting the medium M by a predetermined amount (for one pass) in the transport direction A, stopping the medium M, and discharging an ink while moving the print section 4 in the scanning direction B to form a desired image onto the medium M. The printing apparatus 1 according to the embodiment is a serial printer that repeats alternately transporting the medium M and moving the print section 4 to perform printing. Alternatively, the printing apparatus 1 may be a line printer that continuously performs printing while transporting the medium M using a line head that has nozzles arrayed in line in the width direction of the medium M. Furthermore, for example, the printing apparatus 1 may be a printing apparatus other than the ink jet printer such as a transfer-type printer.

A winding shaft 10 that can wind the medium M as a roll R2 is provided on the downstream side of the print section 4 in the transport direction A of the medium M. In this embodiment, the printing apparatus 1 winds the medium M such that the print surface is outward and accordingly, when winding the medium M, the winding shaft 10 is rotated in a rotation direction C. On the other hand, to wind the medium M such that the print surface is inward, the winding shaft can be rotated in the opposite direction to the rotation direction C.

A tension bar 9 is provided between an end portion of the support section 3 on the downstream side in the transport direction A of the medium M and the winding shaft 10. The tension bar 9 has a section that is extended in the scanning direction B to come into contact with the medium M and can apply a desired tension to the medium M.

Figure 2:
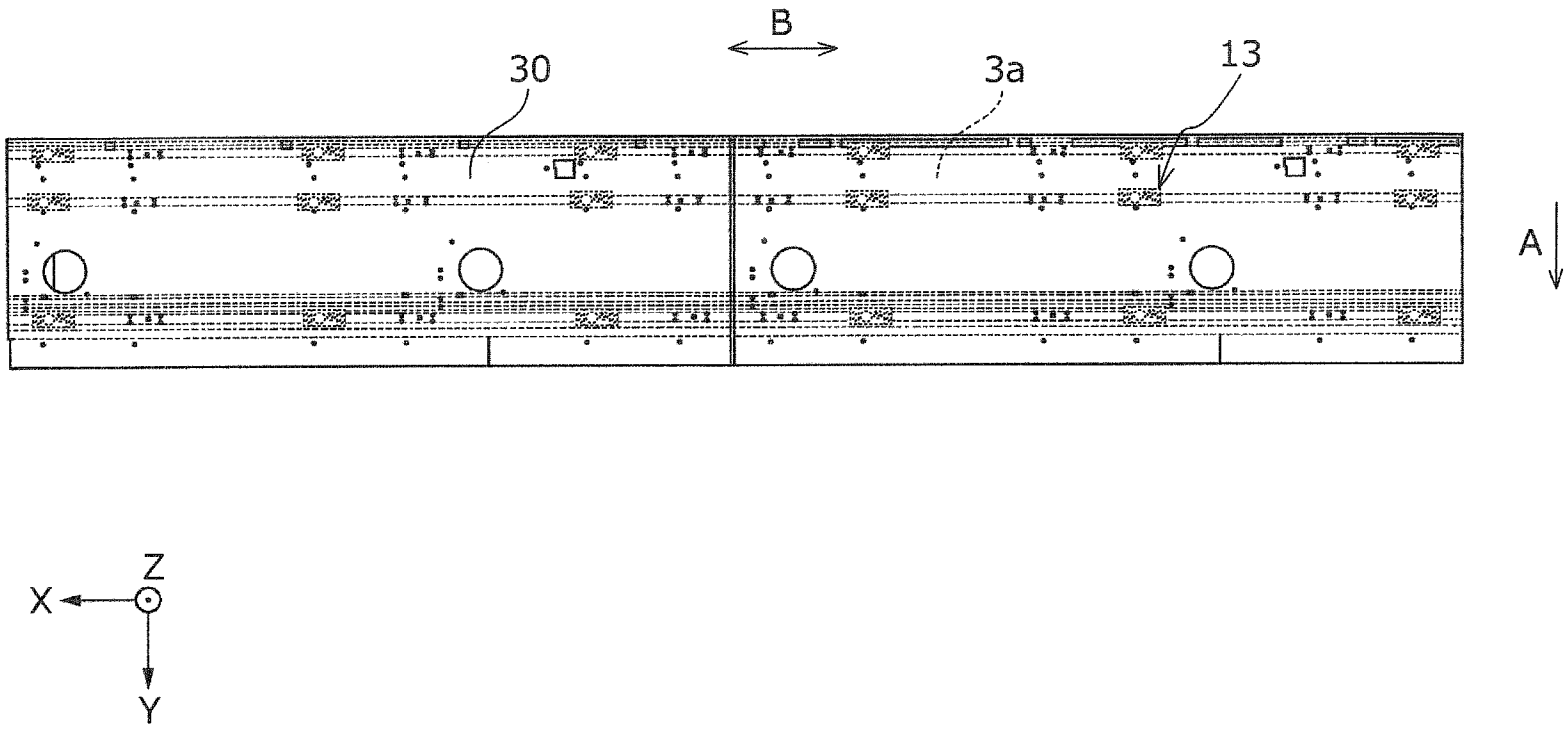
FIG. 2 is a schematic plan view of main components of the printing apparatus according to the first embodiment of the invention.
Figure 3:
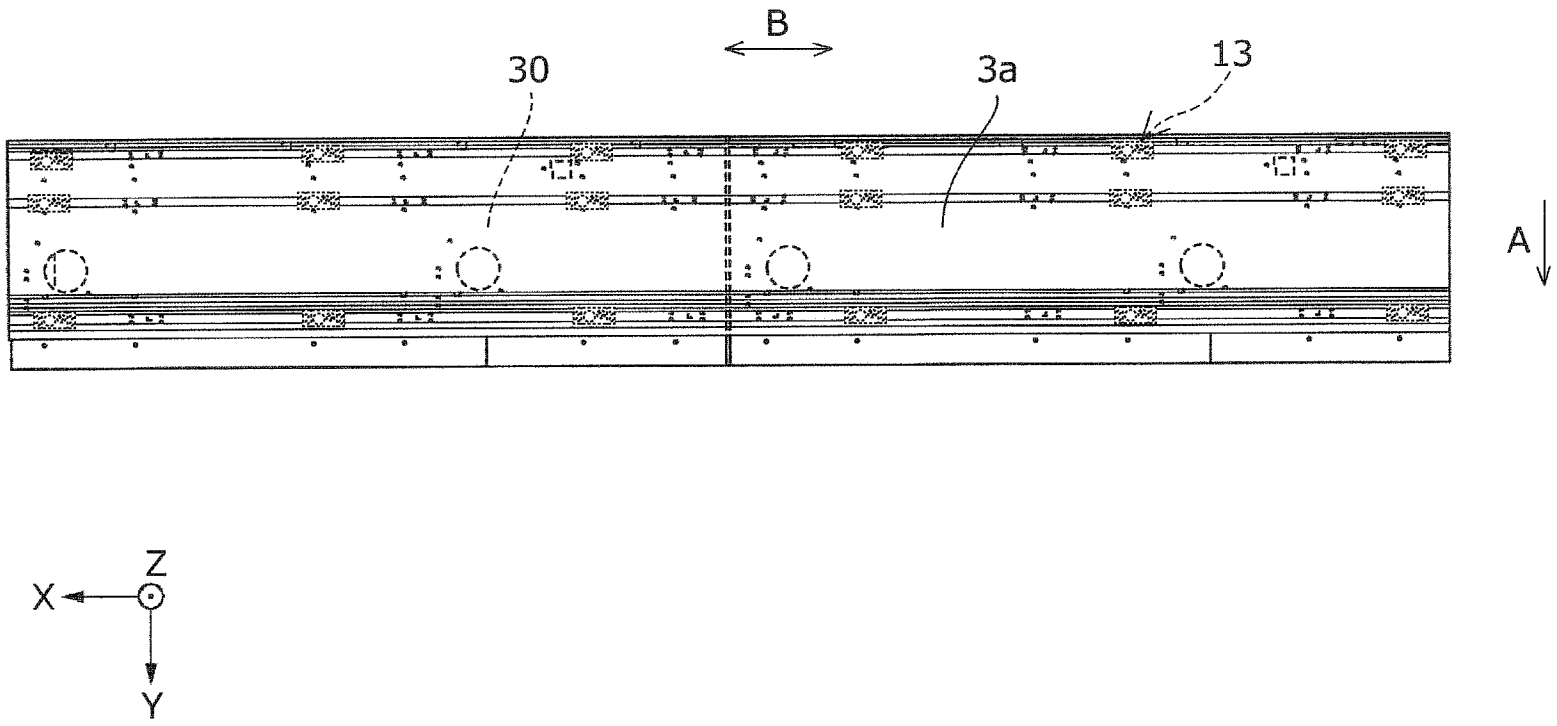
FIG. 3 is a schematic plan view of main components of the printing apparatus according to the first embodiment of the invention.
Figure 4:
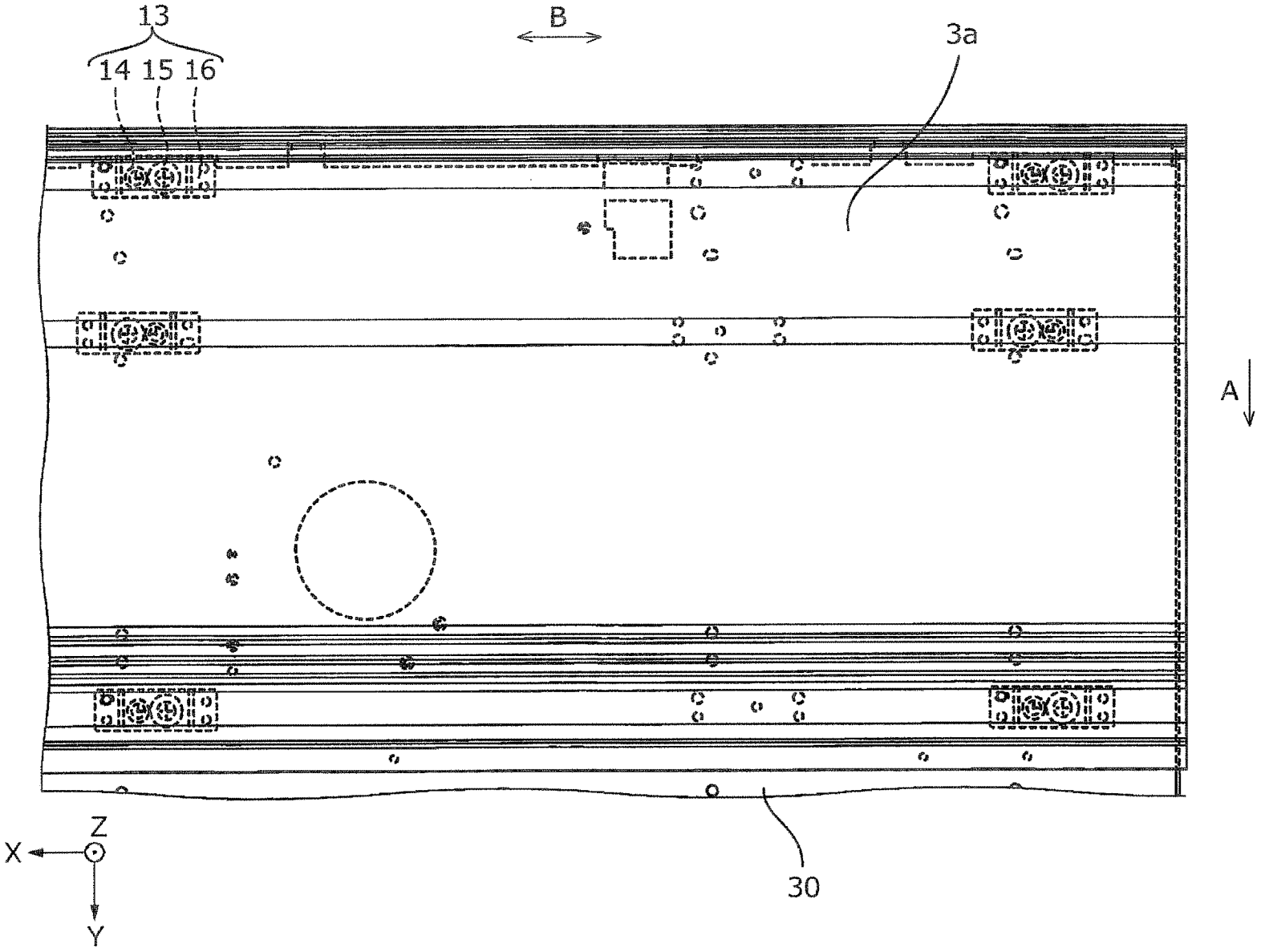
FIG. 4 is a schematic plan view of main components of the printing apparatus according to the first embodiment of the invention.
Figure 5:
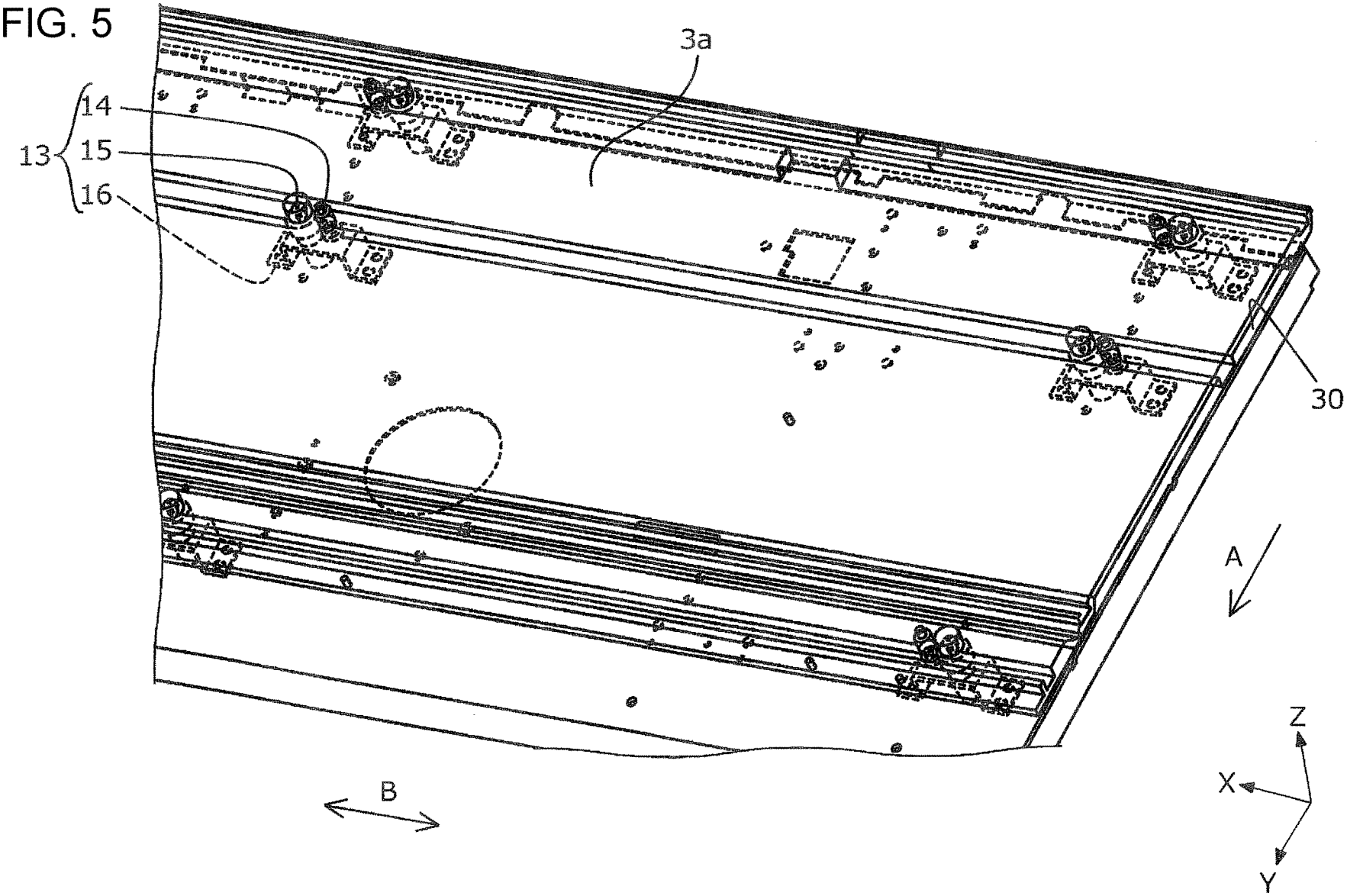
FIG. 5 is a schematic perspective view of main components of the printing apparatus according to the first embodiment of the invention.

Now, the area where the support section 3*a*, which is a main component of the printing apparatus 1 according to the embodiment, is provided will be described in detail below. FIGS. 2 and 3 are schematic plan views of the area where the support section 3*a* is provided. FIG. 2 is a schematic view focusing on a base section 30 to which the support section 3*a* is attached. FIG. 3 is a schematic view focusing on the support section 3*a*. FIG. 4 is a schematic plan view of a part of the area where the support section 3*a* is provided. FIG. 5, which corresponds to FIG. 4, is a schematic perspective view of the area where the support section 3*a* is provided.

As illustrated in FIG. 2 and FIG. 3, in the area where the support section 3*a* is provided, a total of 18 attachment sections 13 are formed: 3 attachment sections 13 are formed in the transport direction A; and 6 attachment sections 13 are formed in the scanning direction B. The attachment sections 13 can be used to attach the support section 3*a* to the base section 30 and can be used to adjust the position of the support section 3*a* to the base section 30 in the direction Z. As illustrated in FIG. 4 and FIG. 5, each of the attachment sections 13 includes a contact section 14, an adjustment section 15, and a base 16 for the contact section 14 and the adjustment section 15. The attachment section 13 according to the embodiment can adjust a position of the support section 3*a* by moving the adjustment section 15, while the support section 3*a* is attached, with respect to the base section 30. Then, the attachment section 13 moves the contact section 14 in the direction Z with respect to the base 16 that is fixed to the base section 30 to bring the contact section 14 into contact with the support section 3*a* whose position has been adjusted and thereby the support section 3*a* can be positioned by the contact section 14 (the contact section 14 is fixed at the position the contact section 14 is in contact with the support section 3*a*). In the printing apparatus 1 according to the embodiment, the attachment section 13 of the support section 3*a* for the base section 30 has such a structure; furthermore, the attachment section of the support section 3*b* for the base section 30 and the attachment section of the support section 3*c* for the base section 30 may have this structure.

Figure 6:
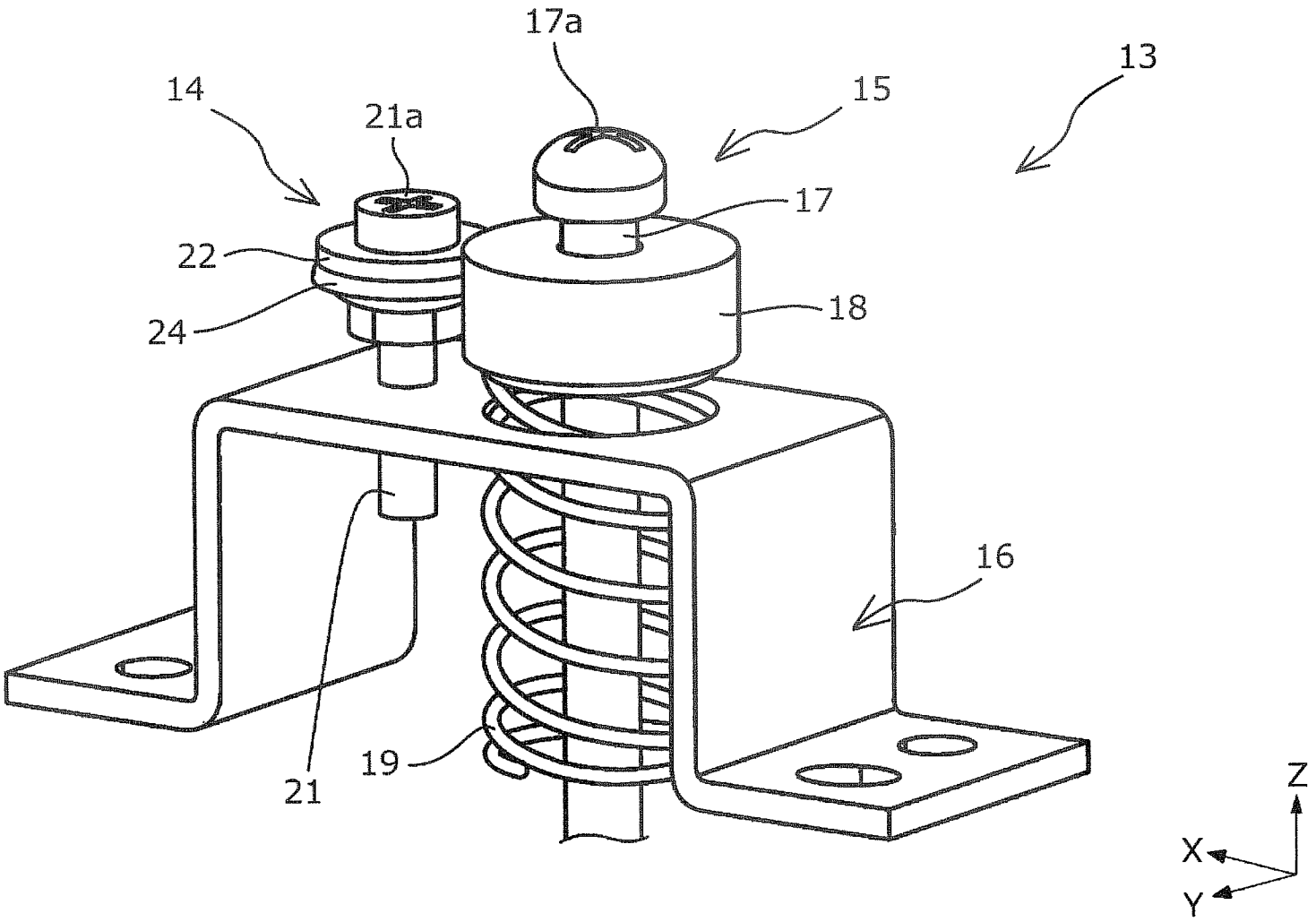
FIG. 6 is a schematic perspective view of main components of the printing apparatus according to the first embodiment of the invention.
Figure 7:
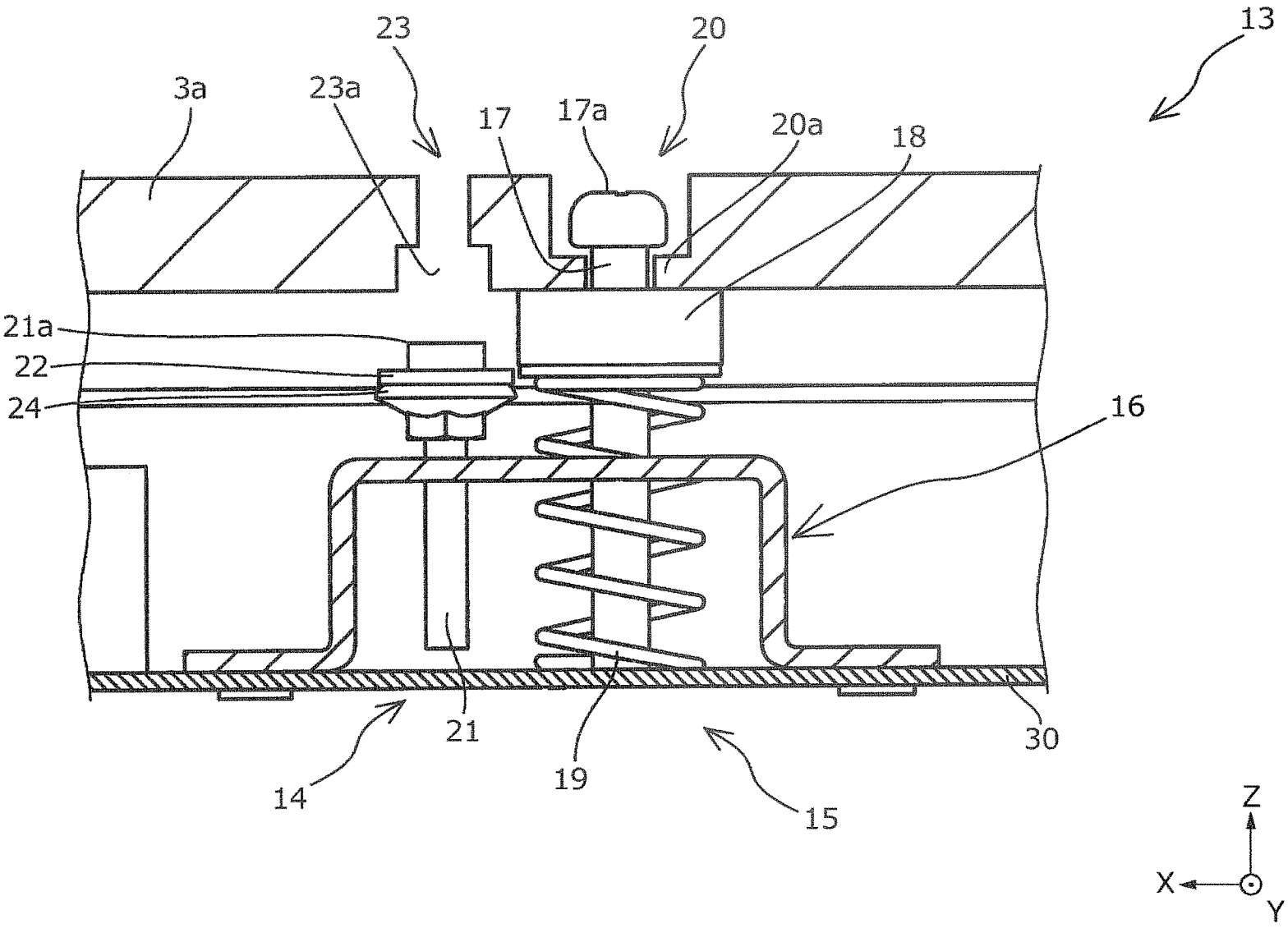
FIG. 7 is a schematic front view of main components of the printing apparatus according to the first embodiment of the invention.
Figure 8:
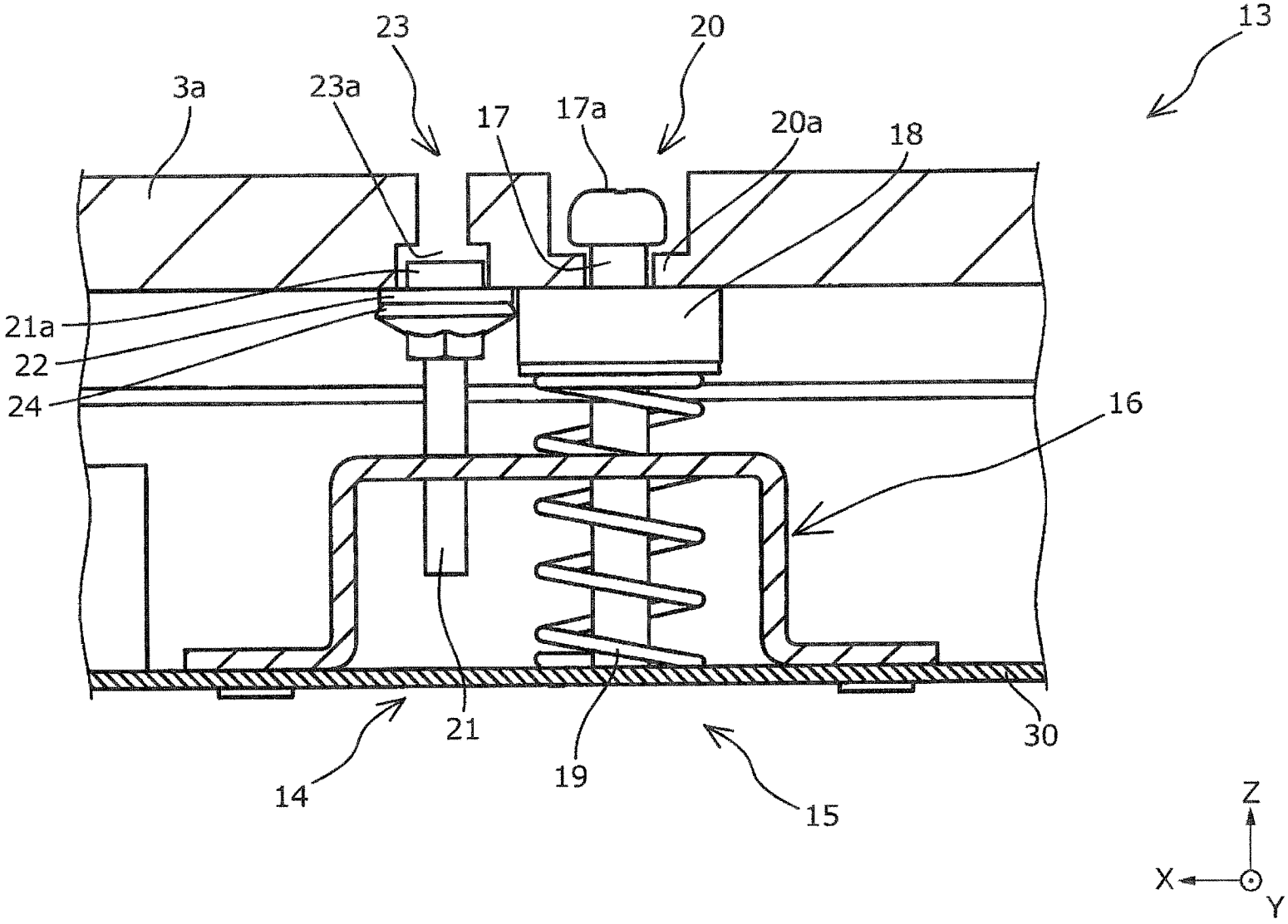
FIG. 8 is a schematic front view of main components of the printing apparatus according to the first embodiment of the invention.

Hereinafter, the attachment section 13, which is a main component of the printing apparatus 1 according to the embodiment, will be further described in detail. FIG. 6 is a schematic perspective view of the attachment section 13. FIG. 7 and FIG. 8 are schematic front views of the attachment section 13 that is attached to the base section 30 and to which the support section 3*a* is attached. FIG. 7 schematically illustrates the attachment section 13 that adjusts a position of the support section 3*a* in the direction Z with the adjustment section 15. FIG. 8 schematically illustrates the attachment section 13 in which the contact section 14 is in contact with the support section 3*a* at the position the support section 3*a* has been adjusted by the adjustment section 15.

As illustrated in FIG. 6 to FIG. 8, the adjustment section 15 includes a screw 17 that can be moved with respect to the base section 30 in the direction Z, a resin washer 18, and a coil spring 19. A screw head 17*a* of the screw 17 adjusts the position of the support section 3*a* with respect to the base section 30 by holding a step portion 20*a* of the screw hole 20 of the support section 3*a*, the washer 18, and the coil spring 19 with the base section 30 through a screw hole 20. Although the resin washer 18 and the coil spring 19 may be omitted from the adjustment section 15, the resin washer 18 can suppress damage to the support section 3*a* and the coil spring 19 can suppress loosening of the screw 17 due to vibrations.

As illustrated in FIG. 7 and FIG. 8, the base 16 is fixed to the base section 30. As illustrated in FIG. 6 to FIG. 8, the contact section 14 includes a screw 21 that can be moved with respect to the base 16 in the direction Z and a resin plate-like member 22 as a contact member. A screw head 21*a* of the screw 21 is a section where a screwdriver (driver) is fitted. The screw 21 has a plate-like member receiving section 24 on a side closer to a screw shaft than the screw head 21*a*. Specifically, the plate-like member receiving section 24 is a flange nut (nut that has a flange portion) that is attached to the screw 21. As illustrated in FIG. 8, the plate-like member 22 that is disposed on the plate-like member receiving section 24 can come into contact with the support section 3*a*. As illustrated in FIG. 7 and FIG. 8, a screw hole 23 is provided in the support section 3*a* at a position corresponding to the contact section 14 such that a screwdriver can access the screw head 21*a* of the screw 21 from an upper side (print section 4 side) of the support section 3*a*. Furthermore, as illustrated in FIG. 8, a lower portion 23*a* of the screw hole 23 is large enough to accommodate the screw head 21*a*. With this structure, only the plate-like member 22 of the contact section 14 comes into contact with the support section 3*a* (the screw head 21*a* does not contact the support section 3*a*). With the contact section 14 having such a structure, when an existing support section 3*a* is replaced by detaching the support section 3*a* from the base section 30 and attaching a new support section 3*a* to the base section 30, the position of the new support section 3*a* with respect to the base section 30 is not changed from the position where the old support section 3*a* was attached. Although the adjustment section 15 and the contact section 14 can be integrally configured, the separately configured adjustment section 15 and contact section 14 can more effectively suppress deformation of the support section 3*a*.

In summary, the printing apparatus 1 according to the embodiment includes the print section 4 that performs printing onto the medium M, the support section 3*a* that supports the medium M, the base section 30 to which the support section 3*a* is attached, and the contact section 14 that is attached to the base section 30 so as to be movable to come into contact with the support section 3*a* and being configured such that the position of the contact section 14 with respect to the base section 30 is not changed when the support section 3*a* is detached from the base section 30. With this structure, when the support section 3*a* is detached from the base section 30, the position of the contact section 14 is not changed, and thereby changes in position of the support section 3*a* due to the replacement of the support section 3*a* can be suppressed.

In other words, by using the printing apparatus 1 according to the embodiment that includes the print section 4 configured to perform printing onto the medium M, the support section 3*a* configured to support the medium M, the base section 30 to which the support section 3*a* is attached, and the contact section 14 configured to be attached to the base section 30 so as to be movable to come into contact with the support section 3*a* and being configured such that a position of the contact section 14 with respect to the base section 30 is not changed when the support section 3*a* is detached from the base section 30, the contact section 14 is operated to bring the contact section 14 into contact with the support section 3*a*, and thereby a method of positioning the support section 3*a* can be performed. By performing the method of positioning the support section, the position of the contact section 14 is not changed even after the support section 3*a* is detached from the base section 30, and the contact section 14 is operated to be moved to come into contact with the support section 3*a*, and thereby changes in position of the the support section 3*a* due to the replacement of the support section 3*a* can be suppressed.

The contact section 14 according to the embodiment includes the screw 21 (screw head 21*a*) as a first section, which is operated to move the contact section 14, and the plate-like member 22 as a second section, which can be brought into contact with the support section 3*a*. In other words, the contact section 14 according to the embodiment includes a first section configured to be operated to move the contact section 14 and a second section configured to be brought into contact with the support section 3*a*, which are provided separately. Accordingly, the respective functions of the first section and the second section can be clearly separated, and the operation of moving the contact section 14 can be appropriately performed.

The screw 21 (screw head 21*a*) of the printing apparatus 1 according to the embodiment is configured not to contact the support section 3*a*, as described above. The resin plate-like member 22 is configured to have a coefficient of static friction lower than that of the metal screw 21. In other words, the coefficient of static friction of the second section (plate-like member 22) that is brought into contact with the support section 3*a* is relatively low. With this structure, in the printing apparatus 1 according to the embodiment, even if the support section 3*a* expands due to environmental changes such as heat, deformation of the support section 3*a* due to the increased frictional force can be suppressed. It is preferable that the screw 21 (also, the screw 17) be torqued, for example, by using a torque driver to prevent the resin plate-like member 22 (also, the resin washer 18) from being damaged. Although the second section (plate-like member 22) according to the embodiment is made of resin, the material is not limited to the resin, and alternatively, a metal may be used. If the second section is made of a metal, it is preferable that the second section be processed to have a low coefficient of static friction.

As illustrated in FIG. 6 to FIG. 8, the first section of the printing apparatus 1 according to the embodiment is an external thread as the screw 21 to which the plate-like member 22 as the second section can be attached. This structure enables to separately provide the first section, which is operated to move the contact section 14, and the second section, which can be brought into contact with the support section 3*a*, which respectively have different functions. The external thread (screw 21) is employed because the external thread can be easily manufactured and the position of the external thread with respect to an external thread formed section (base 16) can be readily changed by turning the external thread. The plate-like member 22 is employed as the contact section because the plate-like member 22 can be easily manufactured and the plate-like section can firmly support the support section 3*a* with its plane.

Figure 9:
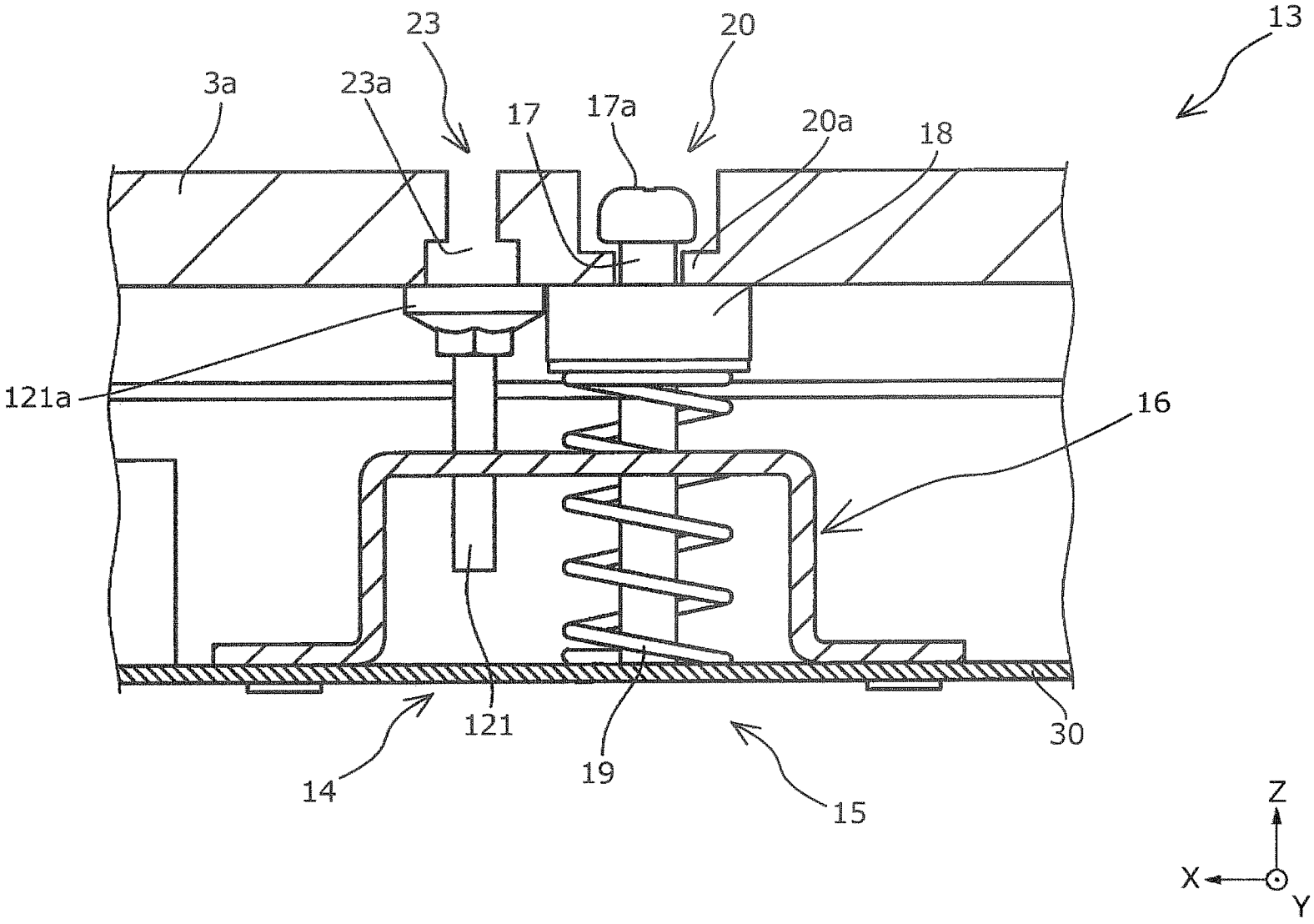
FIG. 9 is a schematic front view of main components of the printing apparatus according to a second embodiment of the invention.

Second Embodiment (FIG. 9)

Next, a printing apparatus according to a second embodiment will be described in detail with reference to the attached drawings. FIG. 9 is a schematic front view of the attachment section 13 that is a main component of the printing apparatus 1 according to the embodiment. FIG. 9 corresponds to FIG. 8 that illustrates the printing apparatus 1 according to the first embodiment. Components that are common to the above-described first embodiment are shown in the same reference numerals, and detailed descriptions of the components are omitted. The printing apparatus 1 according to the embodiment other than the contact section 14 in the attachment section 13 has a structure similar to that of the printing apparatus 1 according to the first embodiment.

The contact section 14 according to the first embodiment separately includes the screw 21 (screw head 21*a*), which is operated to move the contact section 14, and the plate-like member 22, which can be brought into contact with the support section 3*a*. On the other hand, as illustrated in FIG. 9, in the contact section 14 according to the embodiment, a screw head 121*a* of a screw 121 has also the function of the second section that can be brought into contact with the support section 3*a*. With this structure, the contact section 14 can be more readily provided. As illustrated in FIG. 9, the upper portion of the screw head 121*a* according to the embodiment is flat; alternatively, a portion where a screwdriver is fitted may be recessed.

The printing apparatus 1 according to the embodiment includes the support section 3*a* that has, similarly to the printing apparatus 1 according to the first embodiment, the screw hole 23 that is an opening through which the contact section 14 can be accessed from the side of the print section 4. With this structure, the contact section 14 can be accessed and moved from the side of the print section 4 through the screw hole 23. Accordingly, especially in a structure in which a large work space can be provided on the side of the print section 4 in the support section 3*a*, the contact section 14 can be easily operated to be moved. However, the printing apparatus 1 according to the embodiment is not limited to these structures. In the following third and fourth embodiments, example structures in which the contact section 14 can be accessed from a direction intersecting the facing direction (direction along the direction Z) in which the print section 4 and the support section 3*a* face each other will be described. The expression "the contact section 14 can be accessed" means that an operation for moving the contact section 14 can be performed.

Figure 10:
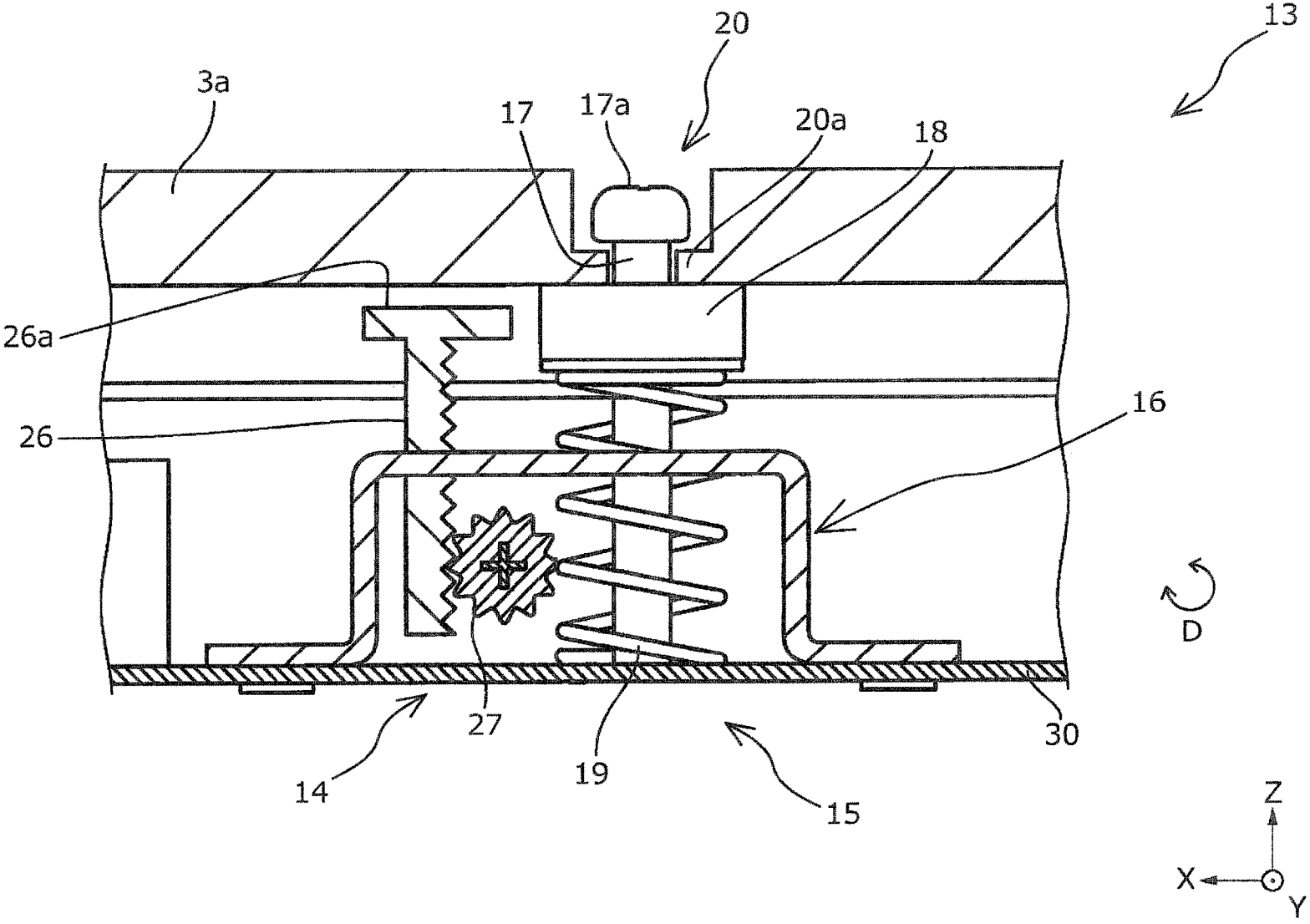
FIG. 10 is a schematic front view of main components of the printing apparatus according to a third embodiment of the invention.
Figure 11:
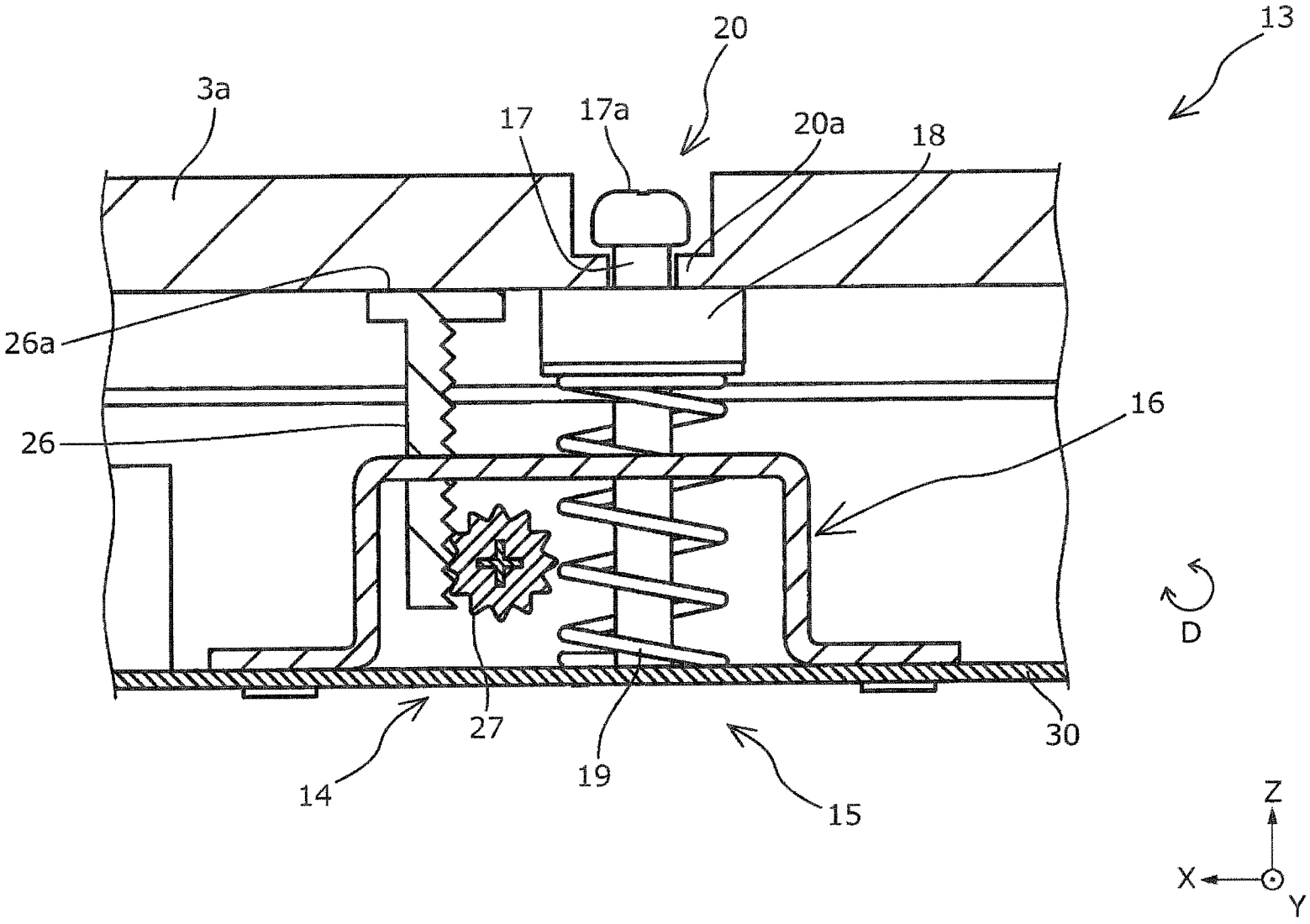
FIG. 11 is a schematic front view of main components of the printing apparatus according to the third embodiment of the invention.

Third Embodiment (FIG. 10 and FIG. 11)

Next, a printing apparatus according to the third embodiment will be described in detail with reference to the attached drawings. FIG. 10 is a schematic front view of the attachment section 13 that is a main component of the printing apparatus 1 according to the embodiment. FIG. 10 corresponds to FIG. 7 that illustrates the printing apparatus 1 according to the first embodiment. FIG. 11 is a schematic front view of the attachment section 13 that is a main component of the printing apparatus 1 according to the embodiment. FIG. 11 corresponds to FIG. 8 that illustrates the printing apparatus 1 according to the first embodiment. Components that are common to the above-described first and second embodiments are shown in the same reference numerals, and detailed descriptions of the components are omitted. The printing apparatus 1 according to the embodiment other than the contact section 14 in the attachment section 13 has a structure similar to those of the printing apparatuses 1 according to the first and second embodiments.

As illustrated in FIG. 10 and FIG. 11, the contact section 14 according to the embodiment includes a pinion 27 that can be accessed by a screwdriver in the direction Y and a rack 26 that can be moved in the direction Z by rotating the pinion 27 in a rotation direction D. The pinion 27 is rotated to move the rack 26 from the state in FIG. 10 to the state in FIG. 11 to bring an upper end portion 26*a* of the rack 26 into contact with the support section 3*a*.

Figure 12:
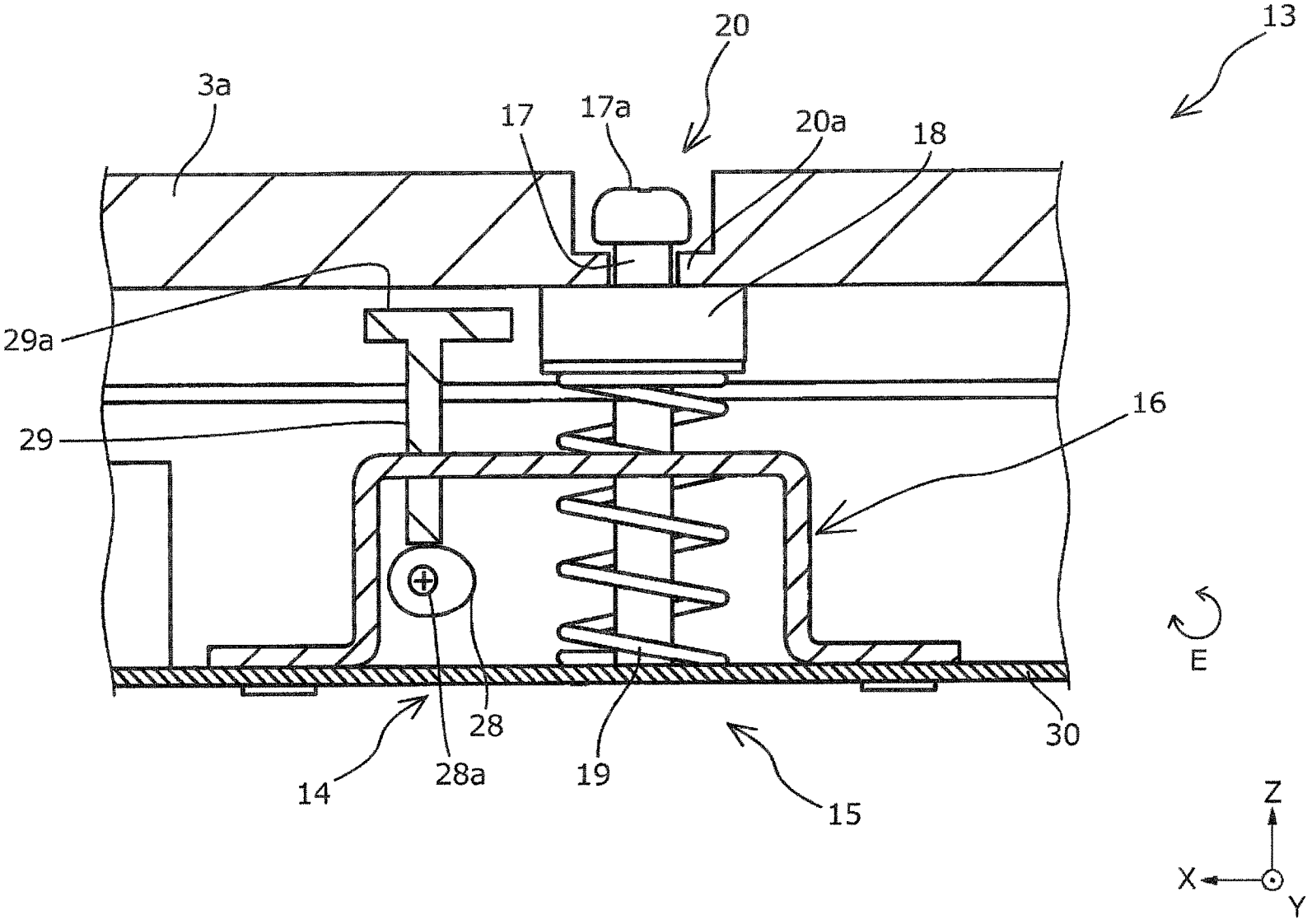
FIG. 12 is a schematic front view of main components of the printing apparatus according to a fourth embodiment of the invention.
Figure 13:
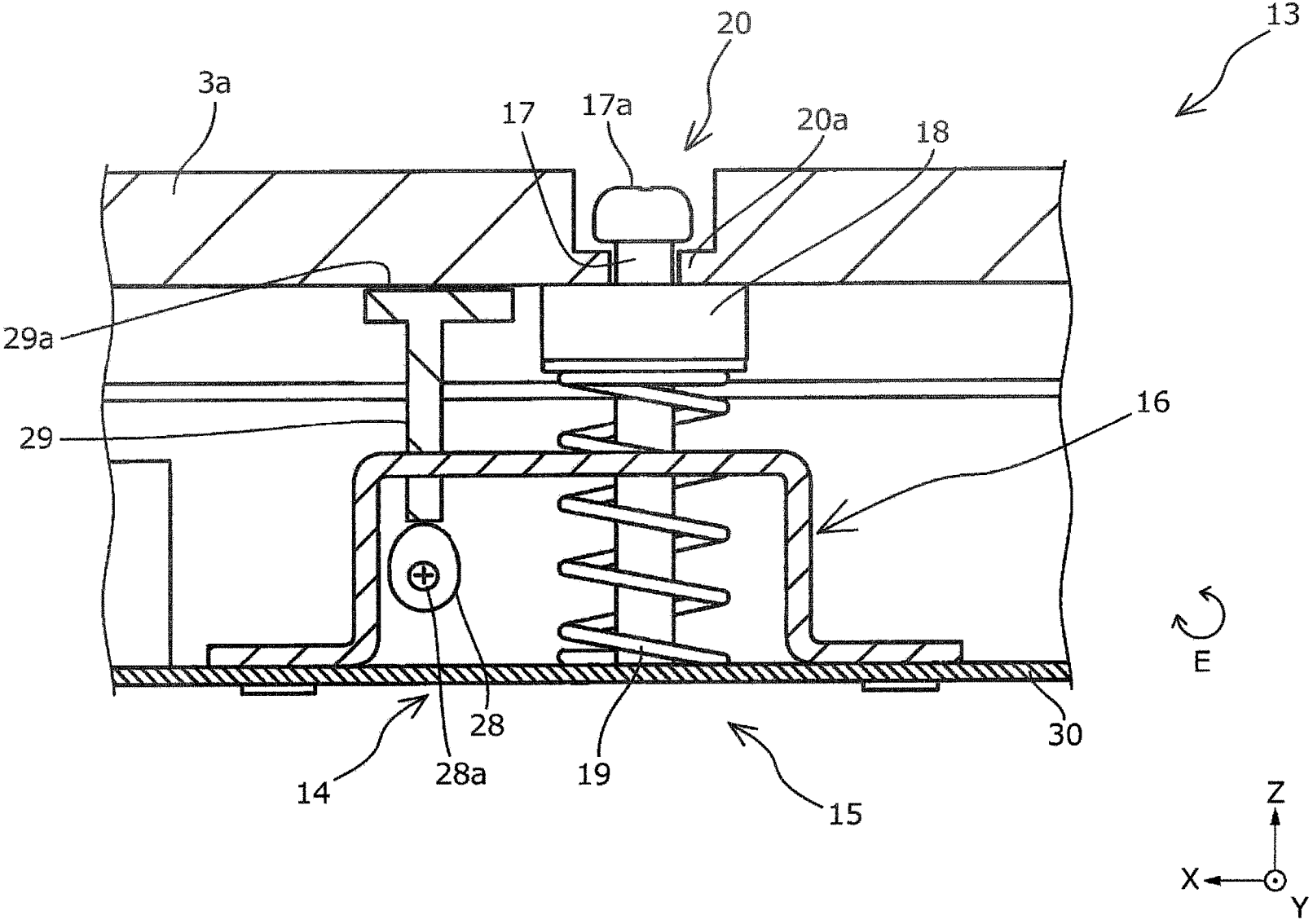
FIG. 13 is a schematic front view of main components of the printing apparatus according to the fourth embodiment of the invention.

Fourth Embodiment (FIG. 12 and FIG. 13)

Next, a printing apparatus according to a fourth embodiment will be described in detail with reference to the attached drawings. FIG. 12 is a schematic front view of the attachment section 13 that is a main component of the printing apparatus 1 according to the embodiment. FIG. 12 corresponds to FIG. 7 that illustrates the printing apparatus 1 according to the first embodiment. FIG. 13 is a schematic front view of the attachment section 13 that is a main component of the printing apparatus 1 according to the embodiment. FIG. 13 corresponds to FIG. 8 that illustrates the printing apparatus 1 according to the first embodiment. Components that are common to the above-described first to third embodiments are shown in the same reference numerals, and detailed descriptions of the components are omitted. The printing apparatus 1 according to the embodiment other than the contact section 14 in the attachment section 13 has a structure similar to those of the printing apparatuses 1 according to the first to third embodiments.

As illustrated in FIG. 12 and FIG. 13, the contact section 14 according to the embodiment includes an eccentric cam 28 and a moving section 29. The eccentric cam 28 includes a rotation shaft 28*a* and can be accessed by a screwdriver in the direction Y. The moving section 29 can be moved in the direction Z by rotating the eccentric cam 28 in a rotation direction E. The eccentric cam 28 is rotated to move the moving section 29 from the state in FIG. 12 to the state in FIG. 13 to bring an upper end portion 29*a* of the moving section 29 into contact with the support section 3*a*. In FIG. 13, when a point on the eccentric cam 28 at which a distance between the rotation shaft 28*a* and the circumference of the eccentric cam 28 is longest comes into contact with the moving section 29, the moving section 29 comes into contact with the support section 3*a*. It should be noted that depending on the position of the support section 3*a* in the direction Z, the position of the eccentric cam 28 to bring the moving section 29 into contact with the support section 3*a* changes.

In the above-described printing apparatuses 1 according to the third and fourth embodiments, the contact section 14 can be accessed from the direction (along the direction Y) intersecting the facing direction (the direction along the direction Z) in which the print section 4 and the support section 3*a* face each other. Accordingly, even in a structure in which a large work space cannot be provided on the side closer to the print section 4 in the support section 3*a*, the contact section 14 can be easily operated to be moved from the direction intersecting the facing direction.

It is to be understood that the present invention is not limited to the above-described embodiments, various modifications can be made within the scope of the following claims, and these modifications are included within the scope of the invention.

This application claims priority under 35 U.S.C. § 119 to Japanese Patent Application No. 2017-018701, filed Feb. 3, 2017. The entire disclosure of Japanese Patent Application No. 2017-018701 is hereby incorporated herein by reference.

What is claimed is:

1. A printing apparatus comprising:

a print section configured to perform printing onto a medium;

a support section configured to support the medium;

a base section to which the support section is attached; and a contact section configured to be attached to the base section so as to be movable to come into contact with the support section and being configured such that a position of a support section side of the contact section with respect to the base section is not changed when the support section is detached from the base section following positioning of the contact section in contact with the support section, wherein the contact section is configured to be moved from a support section side of the contact section.

2. The printing apparatus according to claim 1, wherein the contact section includes a first section configured to be operated to move the contact section and a second section configured to be brought into contact with the support section.

3. The printing apparatus according to claim 2, wherein the first section is configured not to come into contact with the support section, and a coefficient of static friction of the second section is lower than a coefficient of static friction of the first section.

4. The printing apparatus according to claim 2, wherein the first section is an external thread to which the contact section as the second section can be attached.

5. The printing apparatus according to claim 1, wherein the support section has an opening through which the contact section can be accessed from a side of the print section.

6. The printing apparatus according to claim 1, wherein the contact section can be accessed from a direction intersecting a facing direction in which the print section and the support section face each other.

7. A method of positioning a support section for a printing apparatus that includes a print section configured to perform printing onto a medium, a support section configured to support the medium, a base section to which the support section is attached, and a contact section configured to be attached to the base section so as to be movable to come into contact with the support section and being configured such that a position of a support section side of the contact section with respect to the base section is not changed when the support section is detached from the base section following positioning of the contact section in contact with the support section, the method comprising:

operating the contact section from the support section side of the contact section to bring the contact section into contact with the support section to set a separation distance between the support section and the base section.

* * * * *